US007609044B2

(12) United States Patent
Huang

(10) Patent No.: US 7,609,044 B2
(45) Date of Patent: Oct. 27, 2009

(54) CURRENT GENERATOR

(75) Inventor: Chih-Haur Huang, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 247 days.

(21) Appl. No.: 11/808,055

(22) Filed: Jun. 6, 2007

(65) Prior Publication Data

US 2008/0303498 A1 Dec. 11, 2008

(51) Int. Cl.
*G05F 3/16* (2006.01)

(52) U.S. Cl. ..... 323/313

(58) Field of Classification Search ..... 323/280, 323/313, 316

See application file for complete search history.

(56) References Cited

U.S. PATENT DOCUMENTS 7,463,868 B2 * 12/2008 Rofougaran et al. ..... 455/118

2005/0242799 A1 * 11/2005 Erdelyi et al. ..... 323/312

* cited by examiner

*Primary Examiner*—Adolf Berhane
*Assistant Examiner*—Yemane Mehari
(74) *Attorney, Agent, or Firm*—Rabin & Berdo, P.C.

(57) ABSTRACT

A current generator is provided, including a bandgap circuit, an operational amplifier, and an output resistor. The bandgap circuit is used to output a bandgap reference voltage insensitive to environment temperature and supply voltages. The operational amplifier has a positive input receiving the bandgap reference voltage, a negative input, and an output connected to the negative input to obtain an output voltage substantially equal to the bandgap reference voltage. The output resistor is connected to the output of the operational amplifier serially to generate an output current flowing through the output resistor. Thus, the output current generated by the current generator is insensitive to environment temperature and supply voltages, and therefore more accurate and stable.

5 Claims, 2 Drawing Sheets

CURRENT GENERATOR

BACKGROUND OF THE INVENTION

1. Field of the Invention

The invention relates to a current generator capable of outputting an accurate output current that is insensitive to environment temperature and supply voltages.

2. Description of the Related Art

An output current generated by a conventional current generator depends upon supply voltage, environment temperature as well as process corner and resistance shift of resistor, which, in certain situations, may be unexpected and likely to make the following stage malfunction.

FIG. 1 is a circuit diagram of a conventional current generator. In FIG. 1, the output current Ia equals (Vgs-Vt)/Ra, where Vgs is the voltage between the gate and the source of the transistor 110, Vt is the thermal voltage of the transistor 110. Since Vgs depends on the supply voltages Vdd/Vss and Vt is sensitive to the environment temperature, the output current Ia also depends upon the supply voltages and the environment temperature, as well as process corner and resistance shift of the resistor Ra.

SUMMARY OF THE INVENTION

The invention is directed to a current generator. The output current generated by the current generator exhibits little dependence on the environment temperature and the supply voltages.

The current generator of the invention includes a bandgap circuit, an operational amplifier, and an output resistor. The bandgap circuit is used to output a bandgap reference voltage. The operational amplifier has a positive input receiving the bandgap reference voltage, a negative input, and an output connected to the negative input to obtain an output voltage substantially equal to the bandgap reference voltage. The output resistor is connected to the output of the operational amplifier serially to generate an output current flowing through the output resistor.

The invention will become apparent from the following detailed description of the preferred but non-limiting embodiments. The following description is made with reference to the accompanying drawings.

DETAILED DESCRIPTION OF THE INVENTION

Figure 2:
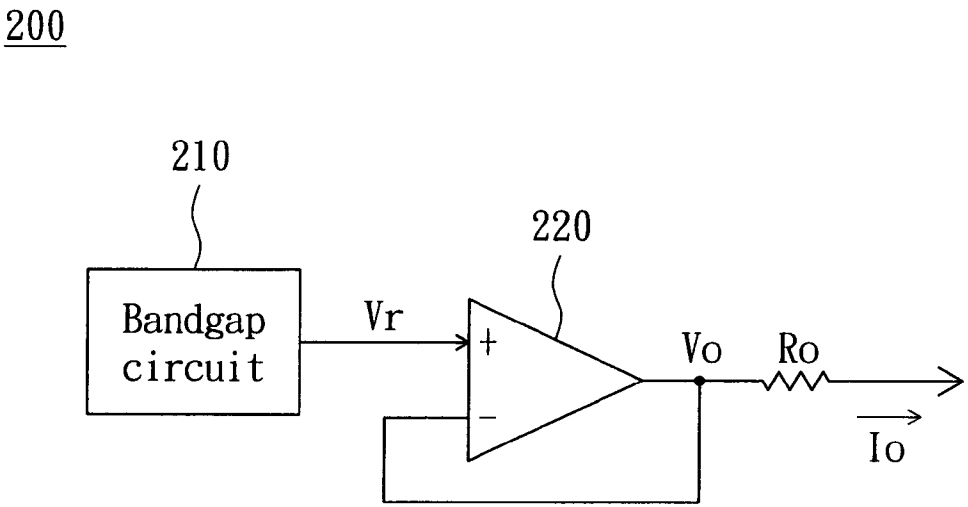
FIG. 2 is a block diagram of a current generator according to an embodiment of the present invention.
Figure 1:
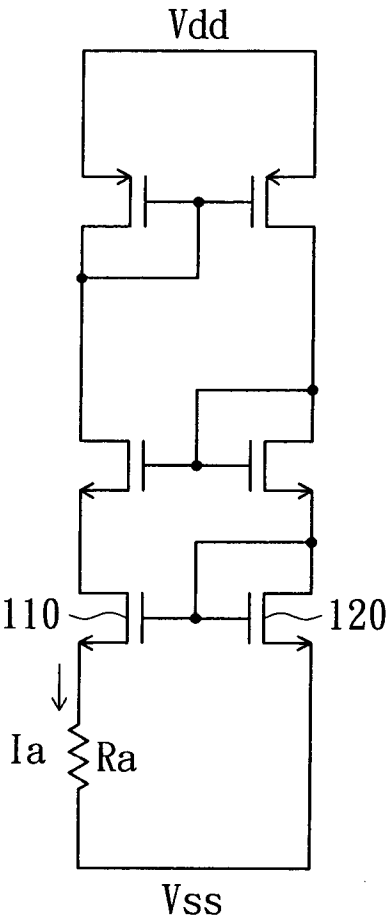
FIG. 1(PRIOR ART)
FIG. 1 is a circuit diagram of a conventional current generator.

FIG. 2 is a block diagram of a current generator according to an embodiment of the present invention. The current generator 200 in FIG. 2 includes a bandgap circuit 210, an operational amplifier 220, and an output resistor Ro. The bandgap circuit may be a PTAT (proportional to absolute temperature) voltage generator. The bandgap circuit 210 is used to output a bandgap reference voltage Vr. The positive input of the operational amplifier 220 receives the bandgap reference voltage Vr. The output and the negative input of the operational amplifier 220 are connected together to generate an output voltage Vo substantially equal to the bandgap reference voltage Vr at the output of the operational amplifier 220.

The output resistor Ro is connected to the output of the operational amplifier 220 serially to generate an output current Io flowing through the output resistor Ro.

The bandgap reference voltage Vr output by the bandgap circuit 210 exhibits little dependence on the environment temperature and the supply voltages. Therefore, by connecting the output and the negative input of the operational amplifier 220, the output voltage Vo substantially equal to Vr and also insensitive to the environment temperature and the supply voltages can be obtained. Thus, the output current Io substantially equal to Vo/Ro is also insensitive to the environment temperature and the supply voltages.

Figure 3:
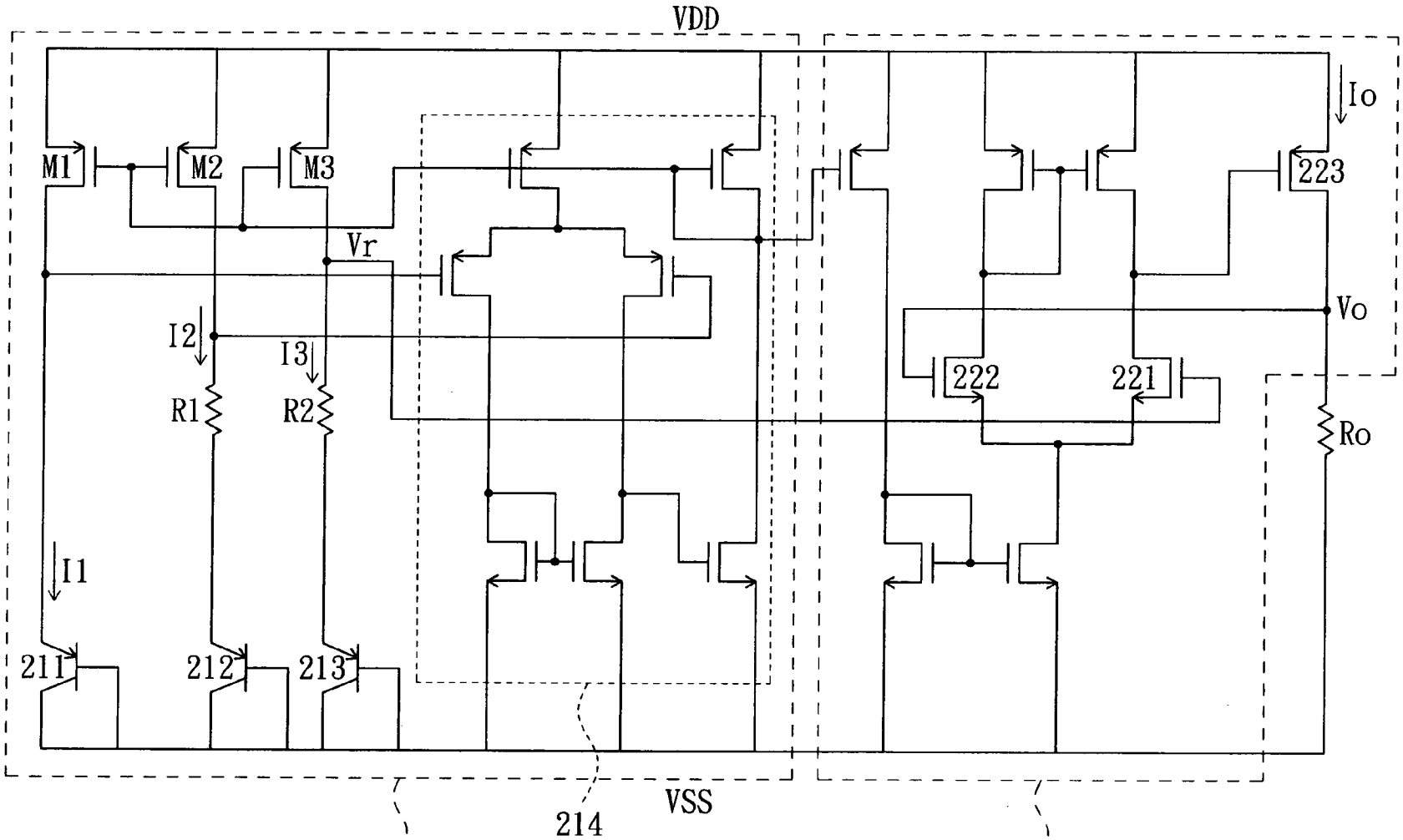
FIG. 3 is a circuit diagram of an implementation of the current generator in FIG. 2.

FIG. 3 is a circuit diagram of an implementation of the current generator 200 in FIG. 2. The bandgap circuit 210 may be a PTAT voltage generator which includes MOS transistors M1, M2, M3, bipolar junction transistors (BJT) 211, 212 and 213, resistors R1 and R2 and a differential amplifier 214. The bases and the collectors of the BJT 211 to 213 are coupled together to the power supply VSS. The MOS transistors M1 to M3 having their sources connected together to the power supply VDD are biased to flow internal currents I1 to I3 through the emitters of the BJT 211 to 213. The resistors R1 and R2 are connected between the emitter of the BJT 212 and the drain of the MOS transistor M2 and between the emitter of the BJT 213 and the drain of the MOS transistor M3.

The internal currents I2 and I3 are substantially equal. The voltages at the drains of the MOS transistors M1 and M2 are substantially equal. These two voltages are fed into the differential amplifier 214 as positive and negative inputs, so as to generate a bias voltage for biasing of the MOS transistors M1 to M3. The differential amplifier 214 can be differential pair amplifier at least having a pair of MOS transistors, as shown in FIG. 3, but not limited thereto.

In this example, the area of the p-n junction of the BJT 212 may be designed N times as the area of the p-n junction of the BJT 211. The bandgap reference voltage Vr is substantially equal to Veb+(R2×Vt×InN)/R1, where Veb is the voltage between the emitter and the base of the BJT 213 and Vt is the thermal voltage of the BJT 211 and 212, which is insensitive to the environment temperature and the supply voltage VDD/VSS.

For example, the operational amplifier 220 may be a differential pair amplifier arranged as a unity-gain amplifier. As shown in FIG. 3, the operational amplifier 220 includes at least a pair of MOS transistors 221, 222 and an output transistor 223. The pair of transistors 221 and 222 is biased to flow a bias current. The output transistor 223 has a source connected to the power supply VDD, a gate connected to the drain of one of the pair of MOS transistors, for example, the MOS transistor 221, and a drain connected to the output resistor Ro. The gates of the transistors 221 and 222 are respectively defined as the positive and negative inputs of the operational amplifier 220, while the drain of the output transistor 223 is defined as the output of the operational amplifier 220. However, the operational amplifier 220 may have other alternatives and should not be limited to the above example.

The output of the operational amplifier 220 is serially connected with the output resistor Ro. In this example, if VDD is equal to 0V, the output current Io is substantially equal to (Veb+(R2×Vt×InN)/R1)/Ro.

Because Veb+(R2×Vt×InN)/R1 is insensitive to the environment temperature and the supply voltages VDD and VSS, the output current Io also exhibits little dependence on the environment temperature and the supply voltages. Hence, the current generator according to the embodiment of the present invention is capable of providing a more accurate and stable output current.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A current generator, comprising:

a bandgap circuit outputting a bandgap reference voltage, the bandgap circuit comprising:

first, second and third bipolar junction transistors (BJT) having their collectors connected together to a negative power supply;

first, second and third MOS transistors having their sources connected together to a positive power supply and respectively biased to flow first, second and third internal currents from their drains into the emitters of the first, second and third BJTs;

first and second resistors respectively connected between the emitter of the second BJT and the drain of the second MOS transistor and between the emitter of the third BJT and the drain of the third MOS transistor; and a differential amplifier generating a bias voltage according to the voltages at the drains of the first and second MOS transistors for biasing of the first, second and third MOS transistors, wherein the voltage at the drain of the third MOS transistor is output as the bandgap reference voltage;

an operational amplifier having a positive input receiving the bandgap reference voltage, a negative input, and an output connected to the negative input to obtain an output voltage substantially equal to the bandgap reference voltage; and an output resistor connected to the output of the operational amplifier serially to generate an output current flowing through the output resistor.

2. The current generator according to claim 1, wherein the bandgap circuit is a PTAT (proportional to absolute temperature) voltage generator.

3. The current generator according to claim 1, wherein the area of the p-n junction of the second BJT is larger than the area of the p-n junction of the first BJT.

4. The current generator according to claim 1, wherein the operational amplifier is a differential pair amplifier.

5. The current generator according to claim 1, wherein the operational amplifier comprises:

a pair of MOS transistors biased to flow a bias current and having their gates defined as positive and negative input; and a output MOS transistor having its gate connecting, to the drain of one of the pair of MOS transistors, having its source connected to a positive power supply, and having its drain outputting the output voltage.

* * * * *